US010638218B2

(12) United States Patent
Slack

(10) Patent No.: US 10,638,218 B2
(45) Date of Patent: Apr. 28, 2020

(54) REFLECTING SOUND FROM ACOUSTICALLY REFLECTIVE VIDEO SCREEN

(71) Applicant: DTS, Inc., Calabasas, CA (US)

(72) Inventor: Brian Slack, Northridge, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 16/110,335

(22) Filed: Aug. 23, 2018

(65) Prior Publication Data

US 2020/0068294 A1 Feb. 27, 2020

(51) Int. Cl.

| | |
|---|---|
| ***H04R 1/34*** | (2006.01) |
| ***H04R 1/26*** | (2006.01) |
| ***H04R 3/14*** | (2006.01) |
| ***H04R 3/04*** | (2006.01) |

(52) U.S. Cl.

CPC ..... *H04R 1/345* (2013.01); *H04R 1/26* (2013.01); *H04R 3/04* (2013.01); *H04R 3/14* (2013.01)

(58) Field of Classification Search

USPC ..... 381/97, 98, 99, 182, 144, 300, 304, 336

See application file for complete search history.

(56) References Cited

U.S. PATENT DOCUMENTS

| | | | | |
|---|---|---|---|---|
| 3,400,217 | A | 9/1968 | Kraut | |
| 4,190,739 | A | 2/1980 | Torffield | |
| 4,642,945 | A * | 2/1987 | Browning | A63J 25/00 352/36 |
| 5,751,821 | A | 5/1998 | Smith | |
| 5,764,777 | A * | 6/1998 | Goldfarb | H04R 1/02 381/27 |
| 6,633,648 | B1 | 10/2003 | Bauck | |
| 7,092,541 | B1 | 8/2006 | Eberbach | |
| 9,986,338 | B2 | 5/2018 | Mansfield et al. | |
| 2006/0050907 | A1 | 3/2006 | Levitsky | |
| 2017/0026750 | A1 * | 1/2017 | Mansfield | H04R 5/02 |
| 2017/0295418 | A1 | 10/2017 | Curtinsmith et al. | |

OTHER PUBLICATIONS

"International Application Serial No. PCT/US2019/043229, International Search Report dated Sep. 12, 2019", 2 pgs.

"International Application Serial No. PCT/US2019/043229, Written Opinion dated Sep. 12, 2019", 4 pgs.

* cited by examiner

*Primary Examiner* — Yosef K Laekemariam

(74) *Attorney, Agent, or Firm* — Schwegman Lundberg & Woessner, P.A.

(57) ABSTRACT

In an audiovisual system, in which video is displayed on a screen that does not permit sound to pass through the screen, such as a light emitting diode panel, a high-frequency speaker positioned above an audience seating area can direct sound toward the screen, so that the screen can reflect the sound toward the audience seating area. The high-frequency speaker can be used with one or more low-frequency speakers positioned at or near the height of the audience seating area. The low-frequency and high-frequency sounds can appear to originate from close to the same height, thereby creating a realistic audio image at the audience seating area. A spectral filter can negate the spectral effects of propagation to and reflection from the screen. Suitable time delays can synchronize the high-frequency sound with the low-frequency sound and with video displayed on the screen.

19 Claims, 2 Drawing Sheets

REFLECTING SOUND FROM ACOUSTICALLY REFLECTIVE VIDEO SCREEN

FIELD OF THE DISCLOSURE

The present disclosure relates to audiovisual systems and methods.

BACKGROUND OF THE DISCLOSURE

Historically, audiovisual systems in a theater or auditorium setting used a screen that reflected video, but was essentially transparent to audio. In these systems, speakers could be placed behind the screen, and sound from the speakers would pass through the screen to an audience seating area.

As video technology evolved, it became practical to use large panels that emit light directly to the audience seating area, such as light emitting diode panels. These panels produced superior video, but were no longer transparent to audio. Speakers could no longer be placed behind these large video panels.

BRIEF DESCRIPTION OF THE DRAWINGS

Corresponding reference characters indicate corresponding parts throughout the several views. Elements in the drawings are not necessarily drawn to scale. The configurations shown in the drawings are merely examples, and should not be construed as limiting the scope of the invention in any manner.

DETAILED DESCRIPTION

Figure 1:
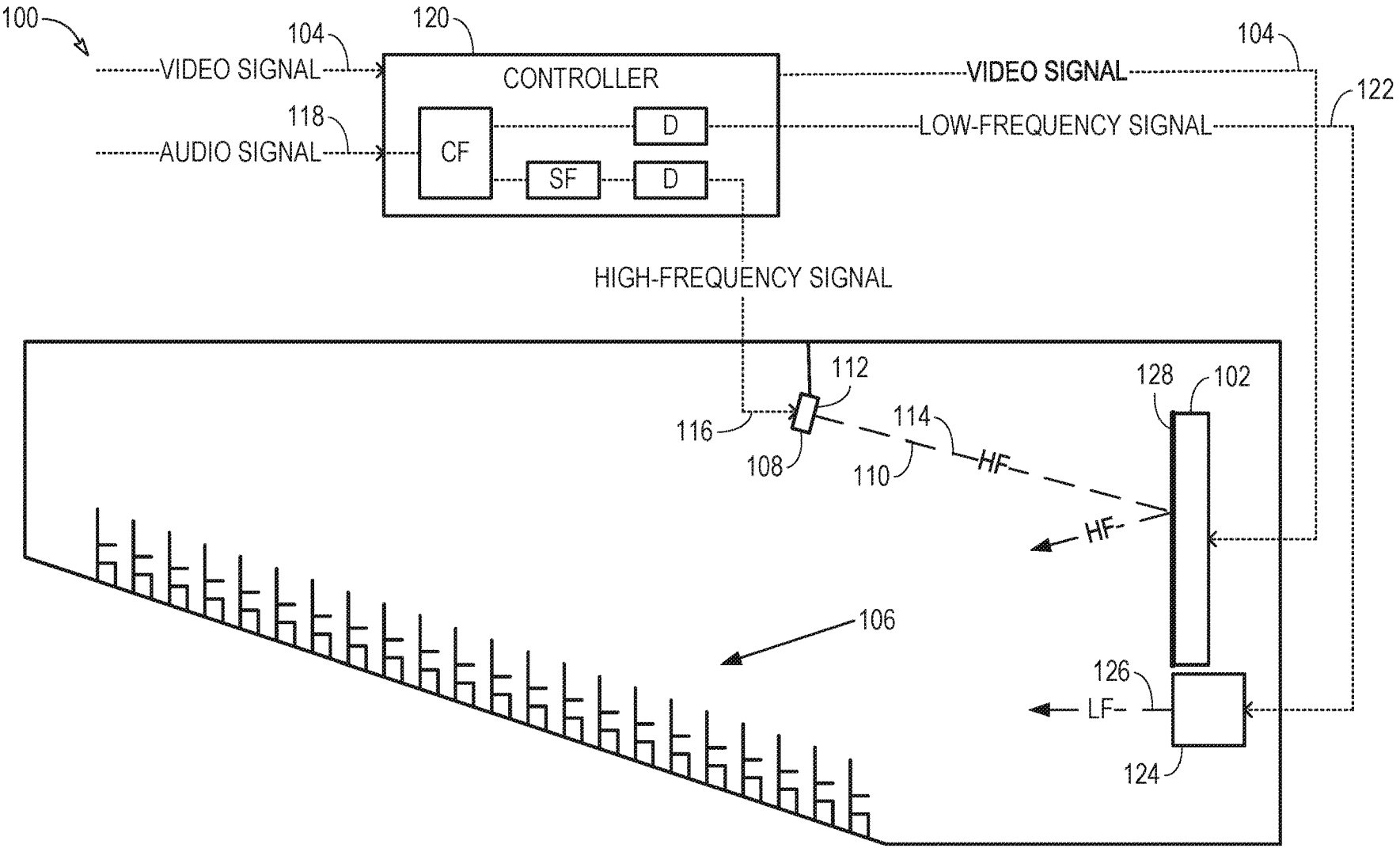
FIG. 1 shows a side view of an example of an audiovisual system, in accordance with some embodiments.

In an audiovisual system, in which video is displayed on a screen that does not permit sound to pass through the screen, such as a light emitting diode panel, an elevated speaker positioned above an audience seating area can direct sound toward the screen, so that the screen can reflect the sound toward the audience seating area. Compared to a system in which a speaker is mounted above the screen and directs its sound directly toward the audience, the reflecting geometry can lower the height from which the sound appears to originate, which can help produce a more realistic audio image at the audience seating area.

The elevated speaker can be a high-frequency speaker, which can produce sound with frequencies above a particular crossover frequency. (Note that audio crossovers can split an audio signal into two or more frequency ranges that correspond to frequency ranges for which particular speakers are designed. For example, an audio crossover can filter out relatively high frequencies, and send only bass frequencies to a subwoofer. A frequency that delineates one frequency range from another is known as a crossover frequency.) In general, high-frequency speakers tend to be relatively small, so that the high-frequency speaker can be mounted at or near a ceiling of a theater or auditorium without attracting much attention.

The high-frequency speaker can be used with one or more low-frequency speakers that produce sound with frequencies below the crossover frequency. The high-frequency speaker and the low-frequency speakers, combined, can provide audio spanning a full range of audible frequencies at the audience seating area.

Because low-frequency speakers tend to be larger than high-frequency speakers, it may not be practical or aesthetically pleasing to suspend the relatively large low-frequency speakers at or near the ceiling of the theater or auditorium. Consequently, the low-frequency speakers can be positioned below a bottom edge of the screen or adjacent to left and right edges of the screen. The low-frequency speakers can direct the low-frequency sound directly at the audience seating area, rather than reflect the low-frequency sound off the screen.

In some examples, the low-frequency speakers can be positioned at or near the height of the audience seating area. In some examples, the height of the low-frequency speakers can be comparable to the apparent height from which the high-frequency sound originates, which can create a more realistic audio image at the audience seating area, and can simplify some of the electronic processing used to further enhance the audio image.

In addition to the reflection off the screen, which improves the audio image by lowering the apparent height of the high-frequency speaker, there are three areas of electronic processing that can further enhance the audio image. All three of these areas can be performed in the electronic domain on signals before the signals are sent to the speakers.

First, a spectral filter can negate the spectral effects of propagation to the screen and reflection from the screen. Such a spectral filter can allow the high-frequency sound reflected from the screen to have the same spectrum as a theoretical case in which the high-frequency speaker is placed at the apparent height from which the high-frequency sound originates (often at or near a height of the low-frequency speakers), and the high-frequency speaker directs its sound directly toward the audience. For example, if propagation to and reflection from the screen attenuates a particular frequency by 4 dB, the spectral filter can boost the particular frequency by 4 dB to compensate for the propagation to and reflection from the screen. This spectral filtering can return the high-frequency sound in an auditorium or theater sound system to a more standard configuration, likely corresponding to a configuration for which the sound was originally mixed.

Second, selection of the crossover frequency can divide the sound between low-frequency speakers and the high-frequency speaker in a beneficial manner. For example, the crossover frequency can be chosen to be as low as is practical, which can boost the amount of sound energy reflected off the screen, and can reduce the amount of low-frequency dispersion caused by reflecting off the screen. For example, it can be beneficial to choose the crossover frequency to be below the frequency range of most human speech, so that vocals in the full audio signal are directly largely or entirely into the high-frequency speaker and are reflected from the screen.

Third, time-adjusting the signals sent to the high-frequency and low-frequency speakers can improve the audio image and improve the experience when the audio accompanies a display of video. The time-adjustment can take the form of delays explicitly added to the signals. For example, applying a first time delay between the low-frequency signal and the high-frequency signal can synchronize the high-frequency sound with the low-frequency sound, and can cause the high-frequency sound to appear to originate from a same plane as the low-frequency sound, which can improve the audio image at the audience seating area. As another example, applying a second time delay to both the low-frequency signal and the high-frequency signal can synchronize the high-frequency sound and the low-frequency sound with video displayed on the screen, which can account for latency caused by processing the video and/or audio signals. As another example, applying a third time delay to both the low-frequency signal and the high-frequency signal can cause the high-frequency sound and the low-frequency sound appear to emerge from the screen, which can account for time-of-flight propagation of sound from the screen (or the plane of origination) to the seats in the audience seating area. The first, second, and third time delays can be combined to form a single time delay applied to the high-frequency signal, and another single time delay applied to the low-frequency signal.

The preceding paragraphs merely provide a summary of subject matter for this document. A full description of the subject matter follows below.

FIG. 1 shows a side view of an example of an audiovisual system 100, in accordance with some embodiments. In some examples, the system 100 of FIG. 1 can reflect high-frequency sound from an elevated high-frequency speaker off a video screen to an audience seating area, and can direct low-frequency sound directly at the audience seating area from low-frequency speakers positioned at or near the height of the audience seating area, so that the low-frequency sound and the reflected high-frequency sound appear to originate from close to the same height, thereby creating a realistic audio image at the audience seating area. The configuration of FIG. 1 is but one example of an audiovisual system 100; other configurations can also be used.

The system 100 can include a screen 102 configured to display video corresponding to a video signal 104. In some examples, the screen 102 can include a panel of light emitting diodes. In some examples, the screen 102 can be relatively large, such as occupying all or most of a vertical wall in a theater. In some examples, the screen 102 can be flat. In other examples, the screen 102 can be curved, such as convex or concave. In some examples, the screen 102 can be acoustically reflective (e.g., can be at least partially reflective to audio). In some examples, the screen 102 can include an audience-facing element, such as a transparent plastic or glass layer, which can reflect sound. In some examples, the audience-facing element can be locally flat or smooth, over a scale comparable to the wavelength of sound. For example, assuming that the speed of sound in air at room temperature is about 340 meters per second, for a frequency of 17 kHz, which is near the upper end of human hearing, the corresponding wavelength is the quantity 340 meters per second, divided by the quantity 17 kHz, or about 2 centimeters. The screen 102 can tolerate local imperfections as large as 2 centimeters, without appreciably affect characteristics of the reflected sound because they are appreciably smaller than the wavelengths of the sound. For lower frequencies, the corresponding wavelengths are even larger, which can further diminish the effects of imperfections, such as surface roughness, seams, screw holes, and the like.

The screen 102 can be positioned in a theater to be viewable from an audience seating area 106. In some examples, the audience seating area 106 can include multiple seats, optionally arranged in rows. In some examples, the audience seating area 106 can lack fixed seats, so that audience members can stand in the audience seating area 106. In general, the system 100 can be designed with the assumption that the audience members have their ears positioned at a fixed height, plus or minus a height tolerance. In this document, the designation of "at or near" can correspond to an expected height of the audience members' ears, plus or minus a specified height tolerance. The height tolerance can be 1 meter, 0.5 meter, 0.25 meter, or another suitable value. In some examples, the audience seating area 106 can be inclined, such as for stadium seating, so that the audience members' ears can be positioned at a specified height above the floor of the audience seating area 106, plus or minus the height tolerance.

An elevatable speaker 108 can be positionable at a first height relative to the audience seating area 106. In some examples, the elevatable speaker 108 can be suspended from a ceiling, or mounted in the ceiling, in some examples, the elevatable speaker 108, when installed, can be positioned above the audience seating area 106. In some examples, the elevatable speaker 108, when installed, can be spaced apart from the screen 102 by one-third of the back wall-to-screen size of the theater, to within 5%, 10%, 15%, 20%, or another suitable value.

The elevatable speaker 108 can produce a first sound 110 associated with the video signal 104. The elevatable speaker 108 can direct the first sound 110 at the screen 102, so that the screen 102 can reflect the first sound 110 toward the audience seating area 106. Positioning the elevatable speaker 108 in this reflecting geometry can lower the location from which the first sound 110 appears to originate, which is beneficial and helps in producing a realistic audio image at the audience seating area 106.

In some examples, the elevatable speaker 108 can be a high-frequency speaker 112. In some examples, the first sound 110 can be high-frequency sound 114. In some examples, the high-frequency sound 114 can be produced in response to a high-frequency signal 116. The high-frequency signal 116 can be analog, such as a time-varying voltage or current, or digital, such as a data stream. In some examples, the high-frequency signal 116 can be generated in response to a full-frequency audio signal 118 that is associated with the video signal 104. In some examples, the high-frequency signal 116 can include frequencies in the full-frequency audio signal 118 that are above a crossover frequency. In some examples, the crossover frequency can be between 200 Hz and 400 Hz, such as 200 Hz, 250 Hz, 300 Hz, 350 Hz, 400 Hz, or a value between 200 Hz and 400 Hz, so that human vocals in the full-frequency audio signal 118, which are typically higher than 200-400 Hz, can be directed into the high-frequency speaker 112. In some examples, the high-frequency speaker 112 can direct the high-frequency sound 114 at the screen 102. In some examples, the screen 102 can reflect the high-frequency sound 114 toward the audience seating area 106.

A controller 120 can receive the full-frequency audio signal 118 associated with the video signal 104. In some examples, a single data signal can include both the video and full-frequency audio signal 118, along with information that can be decoded to drive multi-channel audio. In other examples, the full-frequency audio signal 118 can be a single data signal, separate from the video signal 104, and can include information that can be decoded to drive multi-channel audio. Other configurations are also possible for the full-frequency audio signal 118. In some examples, the controller 120 can separate the full-frequency audio signal 118 from the associated video signal 104. In other examples, the separation can be performed by another component in the system 100, and the controller 120 receives the full-frequency audio signal 118. In still other examples, the system 100 receives only the full-frequency audio signal 118, and does not receive or process the video signal 104.

The controller 120 can generate the high-frequency signal 116 in response to the full-frequency audio signal 118. For example, the controller 120 can apply attenuation associated with a crossover frequency to the full-frequency audio signal 118. As a specific example, to form the high-frequency signal 116 from a crossover frequency of 300 Hz, the controller 120 can apply attenuation (e.g., 20 dB per octave, 40 dB per octave, 60 dB per octave, etc.) below 300 Hz, and can apply a generally flat response (e.g., 0 dB) above 300 Hz. This is but one numerical example; other frequencies, attenuation schemes, and passband gains can also be used.

Similarly, the controller 120 can also generate a low-frequency signal 122 in response to the full-frequency audio signal 118. The low-frequency signal 122 can have frequencies below the crossover frequency. Using the numerical values from the above examples, to form the low-frequency signal 122 from a crossover frequency of 300 Hz, the controller 120 can apply attenuation (e.g., 20 dB per octave, 40 dB per octave, 60 dB per octave, etc.) above 300 Hz, and can apply a generally flat response (e.g., 0 dB) below 300 Hz. This is but one numerical example; other frequencies, attenuation schemes, and passband gains can also be used.

For some of these examples, some frequencies below the crossover frequency can bleed into the high-frequency signal 116, although those frequencies can be increasingly attenuated at frequencies away from the crossover frequency. Similarly, some frequencies above the crossover frequency can bleed into the low-frequency signal 122, although those frequencies can be increasingly attenuated away from the crossover frequency. In other examples, the controller 120 can apply an optional cutoff filter to ensure that no frequencies below the crossover frequency can bleed into the high-frequency signal 116, and/or no frequencies above the crossover frequency can bleed into the low-frequency signal 122.

A low-frequency speaker 124 can produce low-frequency sound 126 in response to the low-frequency signal 122. In some examples, the low-frequency speaker 124 can be positioned under the screen 102, along a bottom edge of the screen 102. In other examples, the low-frequency speaker 124 can be positioned on a left side or a right side of the screen 102. In some examples, the low-frequency speaker 124 can direct the low-frequency sound 126 directly at the audience seating area 106. In some examples, the low-frequency speaker 124 can be positioned at or near a height of the audience seating area 106. In some examples, the high-frequency sound 114 reflected off the screen 102 can appear to originate at a height at or near a height of the low-frequency speaker 124, which can make some of the electronic processing (discussed below) more effective.

Although the system 100 can include a single low-frequency speaker 124, the system 100 can create a more realistic audio image at the audience seating area 106 using multiple, spaced-apart low-frequency speakers 124 at least partially around a perimeter of the audience seating area 106. In some examples, the system 100 can include two low-frequency speakers 124, positioned below the screen 102 along a bottom edge of the screen 102, and/or, optionally, on left and right sides of the screen 102. In some of these examples, the controller 120 can decode a digital or analog audio signal to generate two low-frequency signals 122, corresponding to left and right channels of audio. In some examples, the system 100 can include multiple low-frequency speakers 124 positioned at least partially around the perimeter of the audience seating area 106, including on walls of the theater or auditorium. In some of these examples, the controller 120 can generate multiple low-frequency signals 122, each corresponding to a low-frequency speaker 124. In some examples, the full-frequency audio signal 118 can include data to generate all of the low-frequency signals 122.

In some examples, the controller 120 can allow for adjusting of the crossover frequency. In some examples, the controller 120 can allow a user, such as an installer of the system 100, to manually adjust the crossover frequency. In other examples, the controller 120 can automatically adjust the crossover frequency.

In some examples, the controller 120 can be further configured to apply a spectral filter to the high-frequency signal 116. The spectral filter can be selected to adjust the spectral content of the reflected high-frequency sound 114 to mimic a theoretical case in which the high-frequency speaker 112 is placed at the apparent height from which the high-frequency sound 114 originates (often at or near a height of the low-frequency speakers 124), and the high-frequency speaker 112 directs its sound directly toward the audience. Such a spectral filter can negate the spectral effects of propagation to the screen 102 and reflection from the screen 102, so that the high-frequency sound 114 in an auditorium or theater sound system can sound more like a standard configuration, for which the sound was originally mixed.

In some examples, the spectral filter can be determined based on a first measured signal, taken from sound reflected from the screen 102, and a second measured signal, taken from sound emitted directly from the high-frequency speaker 112. Determining the spectral filter in this manner can require measurements for the specific equipment used, in the specific theater or auditorium.

In other examples, the spectral filter can be selected from a plurality of predetermined spectral filters. In some examples, the predetermined spectral filters can correspond to a respective plurality of distances between the high-frequency speaker 112 and the screen 102. Other predetermined spectral filters can also be used.

In some examples, the controller 120 can impart specified time delays to any or all of the high-frequency 116 and low-frequency signals 122. These time delays can further enhance the audio image at the audience seating area 106. Although there are three specific time delays discussed below, it will be understood that the controller 120 can combine these delays to form a single time delay for the high-frequency signal 116, and single time delays for each of the low-frequency signals 122.

In some examples, the controller 120 can impart a first time delay between the low-frequency signal 122 and the high-frequency signal 116. The first time delay can be selected to synchronize the high-frequency sound 114 with the low-frequency sound 126. This first time delay can account for a time-of-flight for sound between the low-frequency speakers 124 and the apparent location of the high-frequency speaker 112 after reflection. In some examples, the first time delay can effectively position the high-frequency speaker 112, after reflection, in a plane defined by positions of the low-frequency speakers 124.

In some examples, the controller 120 can impart a second time delay to both the low-frequency signal 122 and the high-frequency signal 116. The second time delay can be selected to synchronize the high-frequency sound 114 and the low-frequency sound 126 with the displayed video on the screen 102. This second time delay can account for latencies caused by processing of the audio signal 118 and the video signal 104.

In some examples, the controller 120 can impart a third time delay to both the low-frequency signal 122 and the high-frequency signal 116. The third time delay can be selected to account for time-of-flight propagation of sound from the screen 102 to the seats in the audience seating area 106 such that the high-frequency sound 114 and the low-frequency sound 126 appear to emerge from a plane of the screen 102.

In FIG. 1, the controller 120 is shown to apply a crossover frequency (CF) to the full-frequency audio signal 118, to divide the full-frequency audio signal 118 into the low-frequency signal 122 and the high-frequency signal 116. The controller 120 can apply a low-frequency signal delay (D) to the low-frequency signal 122, and can apply a spectral filter (SF) and a high-frequency signal delay (D) to the high-frequency signal 116, as explained above.

In some examples, the screen 102 can be flat. In other examples, the screen 102 can be convexly curved or concavely curved. In some examples, the screen 102 can have a surface 128 that specularly reflects the high-frequency sound 114 (e.g., reflects the sound in a mirror-like fashion, where an angle of incidence equals an angle of reflection), with a relatively small amount of scattering or diffuse reflection (e.g., where the screen 102 reflects the sound into a range of angles, rather than a single angle of reflection).

In some examples, the high-frequency speaker 112 can have an emission pattern that is operably wider along a vertical direction than along a horizontal direction. Such a high-frequency speaker 112 can have a relatively wide vertical dispersion, and a relatively narrow horizontal dispersion. Such an emission pattern can allow for a relatively large range of incident angles at the screen 102, which in turn can allow a relatively large range of locations in the audience seating area 106 to experience improved sound through the reflected geometry. This large range of locations can include locations relatively close to the screen 102 and relatively far from the screen 102. In addition, such an emission pattern would allow for wide coverage with stadium seating, and can keep the audio image focused to a desired point on the screen, typically at a center of the screen. In some examples, the high-frequency speaker 112 can include multiple drivers, or sound-producing elements, which shape the emission pattern of the high-frequency speaker 112. In general, the greater the number of sound-producing elements, the greater the control over output emission pattern. In some examples, the high-frequency speaker 112 can optionally have a horn that further enhances the directional emission pattern.

Figure 2:
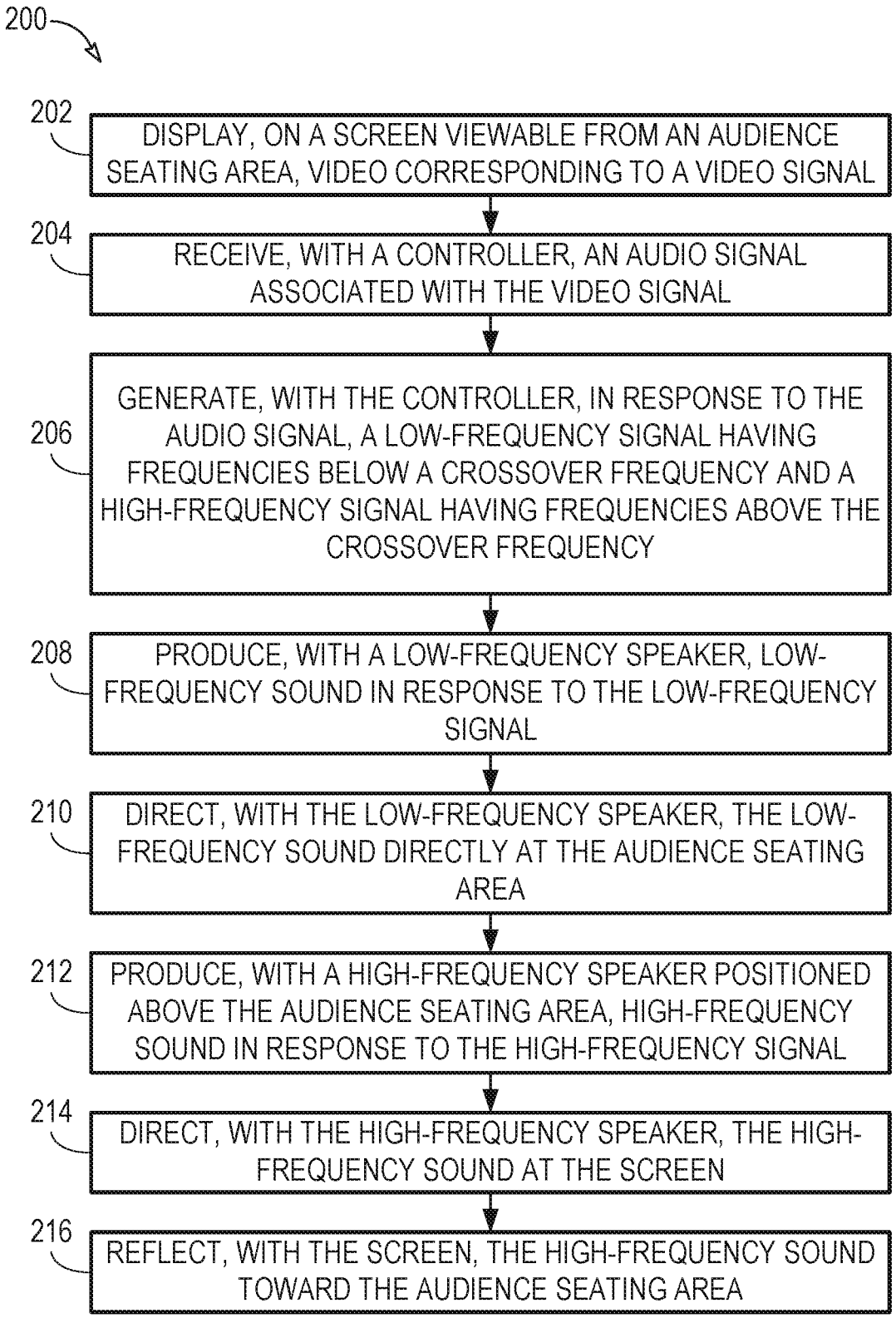
FIG. 2 shows a flowchart of an example of a method for using an audiovisual system, in accordance with some embodiments.

FIG. 2 shows a flowchart of an example of a method 200 for using an audiovisual system, in accordance with some embodiments. The method 200 can be executed by the audiovisual system 100 of FIG. 1, or by any other suitable audiovisual system. The method 200 is but one method for using an audiovisual system; other suitable methods can also be used.

At operation 202, the audiovisual system can display, on a screen viewable from an audience seating area, video corresponding to a video signal.

At operation 204, the audiovisual system can receive, with a controller, an audio signal associated with the video signal.

At operation 206, the audiovisual system can generate, with the controller, in response to the audio signal, a low-frequency signal having frequencies below a crossover frequency and a high-frequency signal having frequencies above the crossover frequency.

At operation 208, the audiovisual system can produce, with a low-frequency speaker, low-frequency sound in response to the low-frequency signal.

At operation 210, the audiovisual system can direct, with the low-frequency speaker, the low-frequency sound directly at the audience seating area.

At operation 212, the audiovisual system can produce, with a high-frequency speaker positioned above the audience seating area, high-frequency sound in response to the high-frequency signal.

At operation 214, the audiovisual system can direct, with the high-frequency speaker, the high-frequency sound at the screen.

At operation 216, the audiovisual system can reflect, with the screen, the high-frequency sound toward the audience seating area.

In some examples, the method 200 can optionally further include imparting, with the controller, a first time delay between the low-frequency signal and the high-frequency signal. The first time delay can be selected to synchronize the high-frequency sound with the low-frequency sound.

In some examples, the method 200 can optionally further include imparting, with the controller, a second time delay to both the low-frequency signal and the high-frequency signal. The second time delay can be selected to synchronize the high-frequency sound and the low-frequency sound with the displayed video on the screen.

In some examples, the method 200 can optionally further include imparting, with the controller, a third time delay to both the low-frequency signal and the high-frequency signal. The third time delay can be selected to account for time-of-flight propagation of sound from the screen to the seats in the audience seating area such that the high-frequency sound and the low-frequency sound appear to emerge from the screen.

In some examples, the method 200 can optionally further include applying, with the controller, a spectral filter to the high-frequency signal. The spectral filter can be selected to adjust the spectral content of the reflected high-frequency sound to mimic a condition in which the high-frequency speaker is positioned at a height of the low-frequency speaker and configured to direct the high-frequency sound directly at the audience seating area.

Other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the system and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can typically be found in devices having at least some minimum computational capability, including, but not limited to, personal computers, server computers, hand-held computing devices, laptop or mobile computers, communications devices such as cell phones and PDAs, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and nonvolatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Blu-ray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CDROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or longlived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

The phrase "audio signal" is a signal that is representative of a physical sound.

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the encoding and decoding system and method described herein, or portions thereof, may be stored, received, transmitted, or read from any desired combination of computer or machine-readable/media or storage devices and communication media in the form of computer executable instructions or other data structures.

Embodiments of the system and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to he performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the scope of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

To further illustrate the device and related method disclosed herein, a non-limiting list of examples is provided below. Each of the following non-limiting examples can stand on its own, or can be combined in any permutation or combination with any one or more of the other examples.

In Example 1, an audiovisual system can include: a screen viewable from an audience seating area and configured to display video corresponding to a video signal; an elevatable speaker positionable at a first height relative to the audience seating area, the elevatable speaker configured to produce a first sound associated with the video signal, the elevatable speaker configured to direct the first sound at the screen, the screen further configured to reflect the first sound toward the audience seating area.

In Example 2, the audiovisual system of Example 1 can optionally be further configured such that: the elevatable speaker is a high-frequency speaker; the first sound is high-frequency sound; the high-frequency sound is produced in response to a high-frequency signal; the high-frequency signal is generated in response to a full-frequency audio signal that is associated with the video signal; the high-frequency signal includes frequencies in the full-frequency audio signal that are above a crossover frequency; the high-frequency speaker is configured to direct the high-frequency sound at the screen; and the screen is further configured to reflect the high-frequency sound toward the audience seating area.

In Example 3, the audiovisual system of any one of Examples 1-2 can optionally be further configured such that the crossover frequency is between 200 Hz and 400 Hz, such that human vocals in the full-frequency audio signal are directed into the high-frequency speaker.

In Example 4, the audiovisual system of any one of Examples 1-3 can optionally further include a controller configured to receive the full-frequency audio signal associated with the video signal, and, in response to the full-frequency audio signal, generate the high-frequency signal.

In Example 5, the audiovisual system of any one of Examples 1-4 can optionally be further configured such that the controller is further configured to generate a low-frequency signal in response to the full-frequency audio signal, the low-frequency signal having frequencies below the crossover frequency; and further including a low-frequency speaker positioned at or near a height of the audience seating area, the low-frequency speaker configured to produce low-frequency sound in response to the low-frequency signal, the low-frequency speaker configured to direct the low-frequency sound directly at the audience seating area.

In Example 6, the audiovisual system of any one of Examples 1-5 can optionally be further configured such that the controller is further configured to apply a spectral filter to the high-frequency signal, the spectral filter selected to adjust the spectral content of the reflected high-frequency sound to mimic a condition in which the high-frequency speaker is positioned at the height of the low-frequency speaker and configured to direct the high-frequency sound directly at the audience seating area.

In Example 7, the audiovisual system of any one of Examples 1-6 can optionally be further configured such that the controller is configured to determine the spectral filter based on a first measured signal, taken from sound reflected from the screen, and a second measured signal, taken from sound emitted directly from the high-frequency speaker.

In Example 8, the audiovisual system of any one of Examples 1-7 can optionally be further configured such that the controller is configured to select the spectral filter from a plurality of predetermined spectral filters that correspond to a respective plurality of distances between the high-frequency speaker and the screen.

In Example 9, the audiovisual system of any one of Examples 1-8 can optionally be further configured such that the controller is further configured to impart a first time delay between the low-frequency signal and the high-frequency signal, the first time delay selected to synchronize the high-frequency sound with the low-frequency sound.

In Example 10, the audiovisual system of any one of Examples 1-9 can optionally be further configured such that the controller is further configured to impart a second time delay to both the low-frequency signal and the high-frequency signal, the second time delay selected to synchronize the high-frequency sound and the low-frequency sound with the displayed video on the screen.

In Example 11, the audiovisual system of any one of Examples 1-10 can optionally be further configured such that the controller is further configured to impart a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

In Example 12, the audiovisual system of any one of Examples 1-11 can optionally be further configured such that the screen is flat and has a surface that specularly reflects the high-frequency sound.

In Example 13, the audiovisual system of any one of Examples 1-12 can optionally be further configured such that the high-frequency speaker has an emission pattern that is operably wider along a vertical direction than along a. horizontal direction.

In Example 14, the audiovisual system of any one of Examples 1-13 can optionally be further configured such that the high-frequency speaker includes multiple sound-producing elements that shape the emission pattern of the high-frequency speaker.

In Example 15, a method can include: displaying, on a screen viewable from an audience seating area, video corresponding to a video signal; receiving, with a controller, an audio signal associated with the video signal; generating, with the controller, in response to the audio signal, a low-frequency signal having frequencies below a crossover frequency and a high-frequency signal having frequencies above the crossover frequency; producing, with a low-frequency speaker, low-frequency sound in response to the low-frequency signal; directing, with the low-frequency speaker, the low-frequency sound directly at the audience seating area; producing, with a high-frequency speaker positioned above the audience seating area, high-frequency sound in response to the high-frequency signal; directing, with the high-frequency speaker, the high-frequency sound at the screen; and reflecting, with the screen, the high-frequency sound toward the audience seating area.

In Example 16, the method of Example 15 can optionally further include imparting, with the controller: a first time delay between the low-frequency signal and the high-frequency signal, the first time delay selected to synchronize the high-frequency sound with the low-frequency sound; a second time delay to both the low-frequency signal and the high-frequency signal, the second time delay selected to synchronize the high-frequency sound and the low-frequency sound with the displayed video on the screen; and a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

In Example 17, the method of any one of Examples 15-16 can optionally further include applying, with the controller, a spectral filter to the high-frequency signal, the spectral filter selected to adjust the spectral content of the reflected high-frequency sound to mimic a condition in which the high-frequency speaker is positioned at a height of the low-frequency speaker and configured to direct the high-frequency sound directly at the audience seating area.

In Example 18, an audiovisual system can include: a screen viewable from an audience seating area and configured to display video corresponding to a video signal; a controller configured to receive an audio signal associated with the video signal, and, in response to the audio signal, generate a low-frequency signal having frequencies below a crossover frequency and a high-frequency signal having frequencies above the crossover frequency; a low-frequency speaker configured to produce low-frequency sound in response to the low-frequency signal, the low-frequency speaker configured to direct the low-frequency sound directly at the audience seating area; and a high-frequency speaker positioned above the audience seating area, the high-frequency speaker configured to produce high-frequency sound in response to the high-frequency signal, the high-frequency speaker configured to direct the high-frequency sound at the screen, the screen further configured to reflect the high-frequency sound toward the audience seating area.

In Example 19, the audiovisual system of Example 18 can optionally be further configured such that the controller is further configured to impart: a first time delay between the low-frequency signal and the high-frequency signal, the first time delay selected to synchronize the high-frequency sound with the low-frequency sound; a second time delay to both the low-frequency signal and the high-frequency signal, the second time delay selected to synchronize the high-frequency sound and the low-frequency sound with the displayed video on the screen; and a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

In Example 20, the audiovisual system of any one of Examples 18-19 can optionally be further configured such that the controller is further configured to apply a spectral filter to the high-frequency signal, the spectral filter selected to adjust the spectral content of the reflected high-frequency sound to mimic a condition in which the high-frequency speaker is positioned at a height of the low-frequency speaker and configured to direct the high-frequency sound directly at the audience seating area.

What is claimed is:

1. An audiovisual system, comprising:

a screen viewable from an audience seating area and configured to display video corresponding to a video signal; and an elevatable high-frequency speaker positionable at a first height relative to the audience seating area, the high-frequency speaker configured to produce a high-frequency sound in response to a high-frequency signal, the high-frequency signal generated in response to a full-frequency audio signal that is associated with the video signal, the high-frequency signal including frequencies in the full-frequency audio signal that are above a crossover frequency, the high-frequency speaker configured to direct the high-frequency sound at the screen, the screen further configured to reflect the high-frequency sound toward the audience seating area.

2. The audiovisual system of claim 1, wherein the crossover frequency is between 200 Hz and 400 Hz, such that human vocals in the full-frequency audio signal are directed into the high-frequency speaker.

3. The audiovisual system of claim 1, further comprising a controller configured to receive the full-frequency audio signal associated with the video signal, and, in response to the full-frequency audio signal, generate the high-frequency signal.

4. The audiovisual system of claim 3, wherein the controller is further configured to generate a low-frequency signal in response to the full-frequency audio signal, the low-frequency signal having frequencies below the crossover frequency; and further comprising a low-frequency speaker positioned at or near a height of the audience seating area, the low-frequency speaker configured to produce low-frequency sound in response to the low-frequency signal, the low-frequency speaker configured to direct the low-frequency sound directly at the audience seating area.

5. The audiovisual system of claim 4, wherein the controller is further configured to apply a spectral filter to the high-frequency signal, the spectral filter selected to adjust the spectral content of the reflected high-frequency sound to mimic a condition in which the high-frequency speaker is positioned at the height of the low-frequency speaker and configured to direct the high-frequency sound directly at the audience seating area.

6. The audiovisual system of claim 5, wherein the controller is configured to determine the spectral filter based on a first measured signal, taken from sound reflected from the screen, and a second measured signal, taken from sound emitted directly from the high-frequency speaker.

7. The audiovisual system of claim 6, wherein the controller is configured to select the spectral filter from a plurality of predetermined spectral filters that correspond to a respective plurality of distances between the high-frequency speaker and the screen.

8. The audiovisual system of claim 4, wherein the controller is further configured to impart a first time delay between the low-frequency signal and the high-frequency signal, the first time delay selected to synchronize the high-frequency sound with the low-frequency sound.

9. The audiovisual system of claim 8, wherein the controller is further configured to impart a second time delay to both the low-frequency signal and the high-frequency signal, the second time delay selected to synchronize the high-frequency sound and the low-frequency sound with the displayed video on the screen.

10. The audiovisual system of claim 9, wherein the controller is further configured to impart a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

11. The audiovisual system of claim 1, wherein the screen is flat and has a surface that specularly reflects the high-frequency sound.

12. The audiovisual system of claim 1, wherein the high-frequency speaker has an emission pattern that is operably wider along a vertical direction than along a horizontal direction.

13. The audiovisual system of claim 12, wherein the high-frequency speaker includes multiple sound-producing elements that shape the emission pattern of the high-frequency speaker.

14. A method, comprising:

displaying, on a screen viewable from an audience seating area, video corresponding to a video signal;

receiving, with a controller, an audio signal associated with the video signal;

generating, with the controller, in response to the audio signal, a low-frequency signal having frequencies below a crossover frequency and a high-frequency signal having frequencies above the crossover frequency;

producing, with a low-frequency speaker, lo frequency sound in response to the low-frequency signal;

directing, with the low-frequency speaker, the low-frequency sound directly at the audience seating area;

producing, with a high-frequency speaker positioned above the audience seating area, high-frequency sound in response to the high-frequency signal;

directing, with the high-frequency speaker, the high-frequency sound at the screen; and reflecting, with the screen, the high-frequency sound toward the audience seating area.

15. The method of claim 14, further comprising imparting, with the controller:

a first time delay between the low-frequency signal and the high-frequency signal, the first time delay selected to synchronize the high-frequency sound with the low-frequency sound;

a second time delay to both the low-frequency signal and the high-frequency signal, the second time delay selected to synchronize the high-frequency sound and the low-frequency sound with the displayed video on the screen; and a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

16. The method of claim 14, further comprising applying, with the controller, a spectral filter to the high-frequency signal, the spectral filter selected to adjust the spectral content of the reflected high-frequency sound to mimic a condition in which the high-frequency speaker is positioned at a height of the low-frequency speaker and configured to direct the high-frequency sound directly at the audience seating area.

17. An audiovisual system, comprising:

a screen viewable from an audience seating area and configured to display video corresponding to a video signal;

a controller configured to receive an audio signal associated with the video signal, and, in response to the audio signal, generate a low-frequency signal having frequencies below a crossover frequency and a high-frequency signal having frequencies above the crossover frequency;

a low-frequency speaker configured to produce low-frequency sound in response to the low-frequency signal, the low-frequency speaker configured to direct the low-frequency sound directly at the audience seating area; and a high-frequency speaker positioned above the audience seating area, the high-frequency speaker configured to produce high-frequency sound in response to the high-frequency signal, the high-frequency speaker configured to direct the high-frequency sound at the screen, the screen further configured to reflect the high-frequency sound toward the audience seating area.

18. The audiovisual system of claim 17, wherein the controller is further configured to impart:

a first time delay between the low-frequency signal and the high-frequency signal, the first time delay selected to synchronize the high-frequency sound with the low-frequency sound;

a second time delay to both the low-frequency signal and the high-frequency signal, the second time delay selected to synchronize the high-frequency sound and the low-frequency sound with the displayed video on the screen; and a third time delay to both the low-frequency signal and the high-frequency signal, the third time delay selected to account for time-of-flight propagation of sound from the screen to the seats in the audience seating area such that the high-frequency sound and the low-frequency sound appear to emerge from the screen.

19. The audiovisual system of claim 17, wherein the controller is further configured to apply a spectral filter to the high-frequency signal, the spectral filter selected to adjust the spectral content of the reflected high-frequency sound to mimic a condition in which the high-frequency speaker is positioned at a height of the low-frequency speaker and configured to direct the high-frequency sound directly at the audience seating area.

* * * * *